United States Patent [19]

Roder

[11] Patent Number: 4,577,372

[45] Date of Patent: Mar. 25, 1986

[54] DRAWING FRAME

[75] Inventor: Kurt Roder, Seuzach, Switzerland

[73] Assignee: Rieter Machine Works, Ltd., Winterthur, Switzerland

[21] Appl. No.: 622,625

[22] Filed: Jun. 20, 1984

[30] Foreign Application Priority Data

Jun. 21, 1983 [CH] Switzerland ..... 3382/83

[51] Int. Cl.[4] ..... D01H 5/00

[52] U.S. Cl. ..... 19/159 A; 19/157; 19/243

[58] Field of Search ..... 19/159 A, 157, 236, 19/243, 287, 288

[56] References Cited

U.S. PATENT DOCUMENTS

| | | | |
|---|---|---|---|
| 2,948,025 | 8/1960 | Schütz | 19/157 |
| 3,038,216 | 6/1962 | Naegeli | 19/157 X |
| 3,067,471 | 12/1962 | Noda | 19/243 |
| 3,224,181 | 12/1965 | Johnson | 19/243 X |
| 3,249,968 | 5/1966 | Whitehurst | 19/159 A |
| 3,263,281 | 8/1966 | Cole | 19/160 |
| 3,327,356 | 6/1967 | Andreani | 19/243 |
| 4,112,548 | 9/1978 | Sauvage | 19/243 |
| 4,227,848 | 10/1980 | Kriechbaum et al. | 19/159 A |
| 4,463,480 | 8/1984 | Oehy et al. | 19/159 A |

FOREIGN PATENT DOCUMENTS 1293549 4/1962 France .

*Primary Examiner*—Louis K. Rimrodt
*Assistant Examiner*—J. L. Olds
*Attorney, Agent, or Firm*—Kenyon & Kenyon

[57] ABSTRACT

Each drawing frame of a double drawing frame is provided with a diverting surface so that the transport direction of the infeed slivers removed from the cans to be emptied is arranged substantially at a right angle to the feed direction of these slivers on the sliver infeed of the drawing assembly.

The first drawing passage is so close to and parallel to a second drawing passage that the emptied sliver cans are transported on the shortest path into the readiness position of the empty cans of the adjacent drawing passage. The cans filled by the drawing frames can be brought along the shortest path into a reserve row which is located immediately in front and parallel to the row with the cans to be emptied in the next drawing passage.

3 Claims, 2 Drawing Figures

DRAWING FRAME

Figure 1:
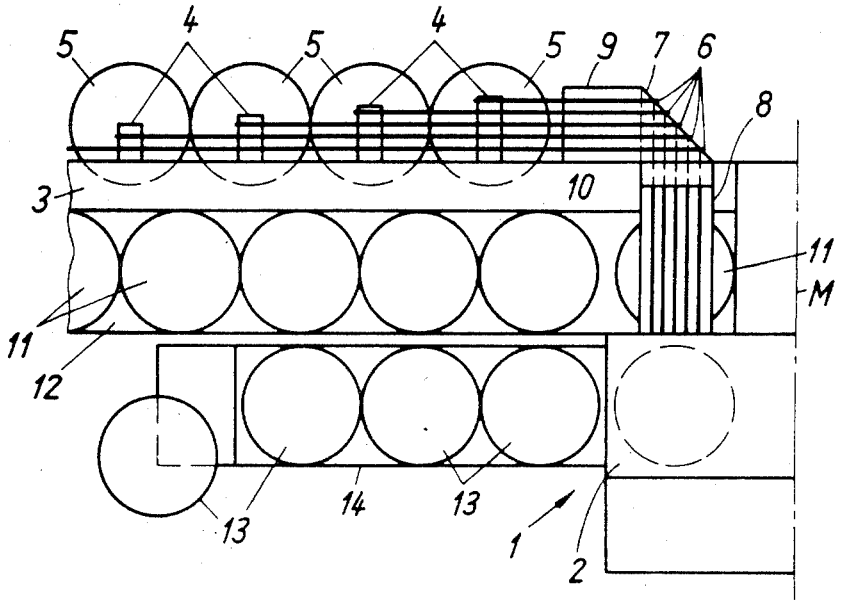

This invention relates to a drawing frame. More particularly, this invention relates to a system of drawing frames for sliver.

Heretofore, various types of drawing frames for fiber slivers have been known. For example, in some cases, the drawing frames have been constructed with a sliver infeed table and a sliver infeed means for delivering fiber slivers to a drawing assembly wherein the transport direction of the infeed table and the infeed means line in a line. However, although such arrangements economize on space and are favorable with respect to the transport of the sliver, these arrangements cannot be put into practice or can only be effected with difficulty.

In other cases, for example as described in German Utility Model No. 74 105 35, it has been known to construct a drawing frame so that the slivers fed into a drawing frame from sliver-containing cans are combined after leaving an infeed table and are guided around a diverting roll forming a part of the sliver infeed table. Thus, the transport direction of the slivers on the infeed table is more suitably arranged substantially at a right angle to the transport direction of the sliver infed to the drawing frame. However, one disadvantage of this diverting arrangement is that the individual slivers must be combined for diversion by the diverting roll.

Accordingly, it is an object of the invention to provide a drawing frame which can efficiently transfer sliver from sliver-containing cans into a drawing assembly in a minimum of space.

It is another object of the invention to provide a drawing frame assembly wherein a plurality of slivers can be diverted without being combined to move although two mutually perpendicular paths into a drawing assembly.

It is another object of the invention to be able to position the cans for two successive drawing frames in facing parallel relation.

It is another object of the invention to be able to effect an exchange of cans from one drawing frame to another over the shortest possible distance.

Briefly, the invention provides a drawing frame which is comprised of a sliver infeed table for receiving and guiding a plurality of slivers in parallel relation in a first direction, a sliver infeed means for feeding the slivers in parallel relation in a second direction perpendicular to the first direction into a drawing assembly and means defining a diverter surface extending from an upper guide plane to a lower guide plane parallel to the upper guide plane in order to divert the slivers from the first direction into the second direction. The diverter surface is such that the slivers can be maintained in spaced apart relation when passing from the upper guide plane to the lower guide plane. That is, the slivers are not combined in order to be fed into the drawing assembly.

In addition, the drawing frame has means for receiving a first row of sliver-containing cans (i.e. the cans to be emptied) at the infeed table and means for receiving a second row of empty cans in parallel relation to the first row and to the first direction, i.e. perpendicular to the infeed means.

At least a pair of drawing frames may be disposed in spaced sequential relation to define a passageway therebetween and with rows of cans in each drawing frame being disposed in parallel to each other and to the rows of cans in the other drawing frame. This arrangement serves to reduce the overall space required for a drawing operation in a plant. In addition, in order to further conserve space, a means is provided for conveying a third row of sliver-filled cans from one drawing frame into a reserve row adjacent to the row of sliver-containing cans of the other drawing frame. Also, a means is provided for conveying empty cans from the row of sliver-containing cans of one drawing frame into a magazine of empty cans in the other drawing frame.

Figure 2:
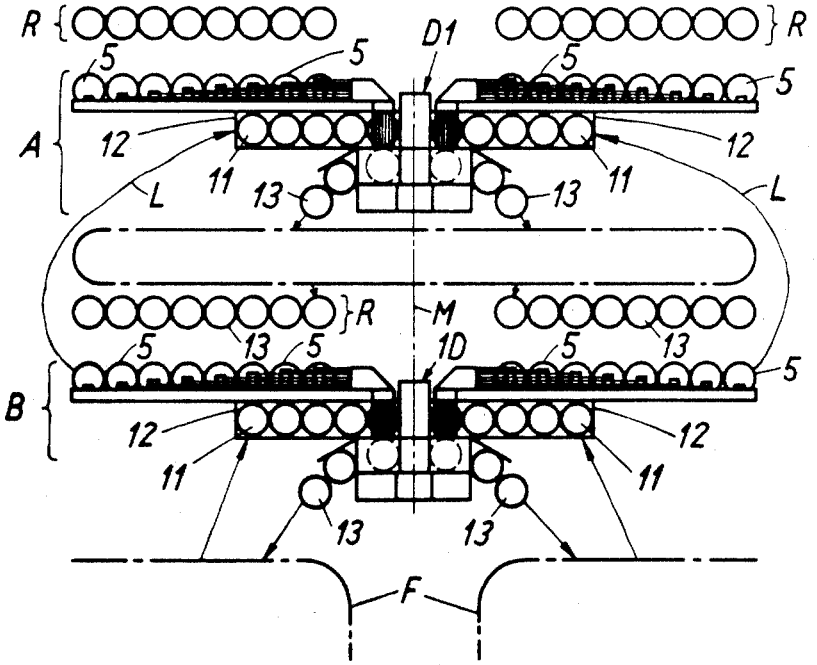

These and other objects and advantages of the invention will become more apparent from the following detailed description taken in conjunction with the accompanying drawings wherein:

FIG. 1 illustrates a plan view of a drawing frame constructed in accordance with the invention; and FIG. 2 illustrates a plan view of a drawing frame assembly on a plant floor in accordance with the invention.

Referring to FIG. 1, the drawing frame 1 includes a machine portion 2 which has a drawing assembly (not shown) located therein. In addition, the drawing frame 1 has a sliver infeed table 3 which has a plurality of rotatable guide rolls 4 which are disposed to receive and guide a plurality of fiber slivers 6 in spaced parallel relation to each other in a first direction as well as a sliver infeed means 8 for feeding the slivers 6 in spaced parallel relation to each other in a second direction perpendicular to the first direction into the drawing assembly in the machine portion 2.

As indicated, means are provided adjacent to the infeed table 3 to receive a first row of sliver-containing cans 5 below the respective guide rolls 4. Each can 5 serves to deliver a fiber sliver 6 to the stream of sliver 6 conveyed by the guide rolls 4.

In addition, the drawing frame has a means in the form of a bent guide plate 7 defining a diverter surface extending from an upper guide plane 9 to a lower guide plane 10 parallel to the upper guide plane in order to divert the slivers 6 from the first direction to the perpendicularly disposed second direction. As indicated, the plate 7 is bent so that the slivers 6 are diverted through an angle of substantial ninety degrees in order to pass into the drawing assembly of the machine portion 2. To this end, the guide plate 7 is bent on a radius of approximately three centimeters between the upper guide plane and the lower guide plane. As such, the bend in the plate provides an external curve surface.

In addition, the drawing frame has a means in the form of a can magazine 12 for receiving a row of empty cans 11 in parallel relation to the row of cans 5 which are to be emptied. As indicated, the row of empty cans 11 is disposed in perpendicular relation to the infeed means 8. Further, a second can magazine 14 is provided to receive a row of sliver-filled cans 13 from the drawing assembly (not shown). In this regard, the collection position of the filled cans 13 is indicated in FIG. 1 with a foremost can 13 being displaced for movement to a further point of use.

In operation, fiber slivers which are removed from cans 5 are guided over the guide rolls 4 onto the upper guide plane 9 of the plate 7 and thereafter passed onto and along the lower guide plane 10 into the sliver infeed means 8 for passage into the drawing assembly (not shown).

In order to be able to place the slivers 6 onto the sliver infeed means 8 after passing the plate 7 and during lead-in of the slivers, the diverting plate 7 is arranged to be higher than the sliver infeed means 8 in such a manner that sufficient space is available for guiding the sliver 6 between the lower guide plane 10 and the sliver infeed means 8.

Of note, a can change apparatus may be incorporated into the drawing frame. For example, the can change apparatus may serve to move the empty cans from an empty can position located under the sliver infeed means 8 into a filling position located under the drawing assembly (not shown) and from the latter into the collection position of the full cans 13. Such a can changing apparatus is known, for example from U.S. Pat. No. 4,463,480, as such, no further description is believed to be required.

As indicated in FIG. 1, the drawing frame is constructed as a single drawing frame. Alternatively, as indicated by the line of symmetry M, the drawing frame may be constructed as a double drawing frame. In this case, a duplicate arrangement of infeed table, infeed means, diverter surface and drawing assembly is provided on the right-hand side, as viewed.

Referring to FIG. 2, wherein like reference characters indicate like parts as above, a plurality of drawing frames may be disposed in spaced sequential relation with passageways defined therebetween, for example on a plant floor. For example, a first drawing frame D1 is disposed in a first drawing frame passage A while a second double drawing frame 1D is disposed in a second drawing frame passage B with their lines of symmetry M lying substantially in the same imaginary vertical plane. In this case, the rows of cans 5, 11 of each drawing frame are arranged in parallel to one another. As indicated, a means is provided for conveying the row of sliver-filled cans 13 from the first drawing frame passage A into a reserve row R adjacent the row of sliver-containing cans 5 of the second drawing frame B. The conveying means used permits the filled cans 13 to be brought over the shortest distance into the reserve row R which lies substantially immediately adjacent and parallel to the row of cans 5 which are to be emptied.

A means is also provided for conveying the emptied cans 5 from the second drawing frame passage B into the magazine 12 of empty cans in the first drawing frame passage A. This conveying means also permits the emptied cans to be transferred along the shortest distance in a direction indicated by the arrow L into the empty can magazine 12. As indicated in FIG. 2, the sliver filled cans 13 may be ejected onto the floor surface in front of the empty cans magazines 12 or onto a collection position as indicated in FIG. 1 prior to transfer into the next drawing frame. For the full cans 13 of the last drawing frame, these may pass into a readiness position F of a succeeding roving frame passage or rotor spinning machine or any other can-using processing stage.

Of note, a carding passage (not shown) can be provided for the first drawing frame passage A and can be supplied in the same manner with emptied cans 5 of the succeeding drawing frame passage A while supplying filled cans into the reserve row R in front of the cans 5 of the drawing frame passage A.

The invention thus provides a drawing frame which occupies a relative minimum of space. Further, the drawing frame permits fiber slivers to be conveyed in spaced apart parallel relation to a drawing assembly while being turned over approximately 90° from one transport direction into another transport direction.

The invention further provides a drawing frame arrangement wherein cans from one drawing frame can be conveyed to an adjacent drawing frame over the shortest distances. Further the drawing frame permits the empty cans, i.e. the cans which have to be filled by a drawing assembly, to be disposed parallel to the sliver-containing cans which are to be emptied.

What is claimed is:

1. In combination, at least a pair of drawing frames disposed in spaced sequential relation to define a passageway therebetween, each said drawing frame having at least one sliver infeed table for receiving and guiding a plurality of slivers in a first direction, a first magazine for receiving a first row of sliver-containing cans at said infeed table, a sliver infeed means for feeding slivers from said infeed table in a second direction perpendicular to said first direction, means to divert the slivers from said first direction to said second direction, and a second magazine for receiving a second row of empty cans in parallel relation to said first row and perpendicular to said infeed means;

said rows of cans of one drawing frame being parallel to said rows of cans of the other drawing frame; and means for conveying a third row of sliver-filled cans from said one drawing frame into a reserve row adjacent said first row of sliver-containing cans of said other drawing frame.

2. The combination as set forth in claim 1 which further comprises means for conveying cans from said first row of sliver-containing cans of said other drawing frame into said second magazine of said one drawing frame.

3. The combination as set forth in claim 1 wherein said means to divert the slivers is a bent guide plate defining an upper guide plane and a lower guide plane parallel to said upper guide plane.

* * * * *

UNITED STATES PATENT AND TRADEMARK OFFICE

CERTIFICATE OF CORRECTION

PATENT NO. : 4,577,372

DATED : March 25, 1986

INVENTOR(S) : Kurt Roder

It is certified that error appears in the above-identified patent and that said Letters Patent is hereby corrected as shown below:

Column 1, line 13 change "line in a line" to -lie in a line-

Column 1, lines 36-7 change "although" to -through-

Column 2, line 35 change "sliver 6" to -slivers 6-

Column 2, line 44 change "substantial" to -substantially-

Signed and Sealed this

*Sixteenth* Day of *September 1986*

[SEAL]

*Attest:*

DONALD J. QUIGG

*Attesting Officer*

*Commissioner of Patents and Trademarks*